US010724164B2

(12) United States Patent
Lonati et al.

(10) Patent No.: US 10,724,164 B2
(45) Date of Patent: Jul. 28, 2020

(54) METHOD AND APPARATUS FOR SEWING AN OPEN END OF A TUBULAR TEXTILE ITEM TO MAKE THE TOE OF A SOCK OR OF A LEG OF A STOCKING

(71) Applicant: SANTONI S.P.A., Brescia (IT)

(72) Inventors: Ettore Lonati, Botticino (IT); Fausto Lonati, Brescia (IT); Andrea Lonati, Brescia (IT)

(73) Assignee: SANTONI S.P.A., Brescia (IT)

( * ) Notice: Subject to any disclaimer, the term of this patent is extended or adjusted under 35 U.S.C. 154(b) by 616 days.

(21) Appl. No.: 15/508,605

(22) PCT Filed: Sep. 2, 2015

(86) PCT No.: PCT/IB2015/056666

§ 371 (c)(1),
(2) Date: Mar. 3, 2017

(87) PCT Pub. No.: WO2016/038509

PCT Pub. Date: Mar. 17, 2016

(65) Prior Publication Data

US 2017/0260669 A1 Sep. 14, 2017

(30) Foreign Application Priority Data

Sep. 11, 2014 (IT) ..... BS2014A000166

(51) Int. Cl.
*D05B 23/00* (2006.01)

(52) U.S. Cl.
CPC ..... *D05B 23/009* (2013.01)

(58) Field of Classification Search
CPC ..... D05B 23/009
(Continued)

(56) References Cited

U.S. PATENT DOCUMENTS 3,952,673 A * 4/1976 Fukuyama ..... D05B 23/009 112/470.15
4,133,280 A * 1/1979 Takatori ..... D05B 23/009 112/470.15

(Continued)

FOREIGN PATENT DOCUMENTS

| | | |
|---|---|---|
| GB | 1 501 869 A | 2/1978 |
| JP | H04-221597 A | 8/1992 |
| WO | 2006/061870 A1 | 6/2006 |

OTHER PUBLICATIONS

Nov. 12, 2015 International Search Report issued in International Patent Application No. PCT/IB2015/056666.

*Primary Examiner* — Nathan E Durham
(74) *Attorney, Agent, or Firm* — Oliff PLC

(57) ABSTRACT

A method for sewing an open end of a tubular textile item so as to make the toe of a sock or of a leg of a stocking, comprising the steps of: loading a tubular item onto a preparation mold, and flatten it to define a first side and a second side; pulling the end portion of the first side so that is elongated, with respect to the end portion of the second side, of a determined length; by keeping the end portion of the first side pulled, simultaneously blocking the two sides so as to make them as one piece; by keeping the two sides blocked, releasing the end portion of the first side, taking the preparation mold out of the tubular item, and simultaneously placing the end portions of the two sides to sewing devices, so as to make a closed toe of the tubular item.

16 Claims, 5 Drawing Sheets

(58) Field of Classification Search
USPC .... 112/470.07, 470.14, 470.15, 153, 475.01, 112/475.03, 475.12, 311
See application file for complete search history.

(56) References Cited

U.S. PATENT DOCUMENTS

| | | | | | |
|---|---|---|---|---|---|
| 5,272,993 | A * | 12/1993 | Gazzarrini | D05B 23/009 | 112/470.15 |
| 5,606,876 | A * | 3/1997 | Sangiacomo | D04B 9/40 | 66/148 |
| 6,158,367 | A * | 12/2000 | Jordan | D05B 23/007 | 112/470.08 |
| 6,779,472 | B1 | 8/2004 | Green et al. | | |
| 7,908,987 | B2 * | 3/2011 | Grassi | D05B 23/009 | 112/475.12 |
| 2006/0213925 | A1 * | 9/2006 | Lonati | D05B 23/007 | 222/75 |
| 2008/0000408 | A1 * | 1/2008 | Magni | D05B 23/009 | 112/470.15 |

* cited by examiner

METHOD AND APPARATUS FOR SEWING AN OPEN END OF A TUBULAR TEXTILE ITEM TO MAKE THE TOE OF A SOCK OR OF A LEG OF A STOCKING

BACKGROUND

The present invention relates to a method and to an apparatus for sewing the toe of tubular textile items on a toe sewing machine. The invention falls into the technical field of machines and equipment for producing stocking and other hosiery items, starting from tubular textile items, and relates in particular to the toe sewing operations in a toe sewing machine.

As is known, the production of hosiery items and stockings consists in closing the tubular textile item, representing e.g. the leg of the stocking or a sock, on its end so as to make a toe: this operation, when automated, typically involves a "toe sewing" machine or "toe closer".

Generally, a "toe closer" comprises a plurality of support tubes onto which the tubular textile items are individually loaded; the machine adapts the open end of the leg to the curve to be obtained for sewing and closes the toe by sewing, then the textile item is unloaded from its respective mold. Typically, toe sewing operations consists in flattening the end of the tubular textile item, so as to define two fabric edges overlapping the end of the tubular textile item, and then sewing such two edges so as to close the textile item and make the toe. The toe, once the textile item is unloaded, is made of an arc-shaped seam defining the closed end of the item.

These toe sewing operations are automated by means of a toe closer, which receives sequentially a plurality of tubular items and sews the toe of each of them; the toe closer is typically characterized by a high operating speed and by a large seaming repeatability, in order to increase global productivity and product uniformity.

An example of a toe closer is described in patent document GB 1501869 A.

The Applicant has found that known methods and apparatuses for seaming the toe of tubular textile items are not without drawbacks and can be improved under various aspects.

A typical drawback of known solutions relates to the manner in which the operating cycle makes the seam at the end of the tubular item: in other words, once the seam is completed, the remaining fabric over the seam, if present, is removed (by cutting), and the sock (or stocking leg) is unloaded from the toe sewing machine, the seam is placed at the end of the two fabric edges of the tubular item which have been flattened before sewing. This means that, once the sock or stocking is fitted onto the user's foot, the seam is placed on the user's foot tip, i.e. at the front end of the foot, where it contacts in particular the toes. This can make the use of the sock or stocking uncomfortable since the seam (which is typically harder, thicker and stiffer of the surrounding, unsewn fabric) can rub over, interfere with or get stuck on the toes. Generally, the extreme position of the seam can be uncomfortable and reduce the comfort of use of the sock or stocking.

These typical drawbacks of socks and stockings made with known methods and apparatuses are more evident in the case of products designed for medical (i.e. therapeutic stocking) or sports use, where a higher comfort in use is required.

Another drawback of known methods and apparatuses consists in making toes of socks and stocking in which the seam, due to its end position, is visible: this can be an undesired aesthetic element and lower the quality of the manufactured sock or stocking.

Another drawback of known methods and apparatuses consists in that the operating cycle is fixed and can only make seams as described above. In detail, known methods and apparatuses can automate the operations for making the toes of socks and stockings, but to this purpose they are necessarily limited to seams as described above, with the disclosed drawbacks. In other words, it is theoretically possible to manually make sock or stocking toes with seams without the drawbacks mentioned above, but it cannot be provided for a seam which is not an arc at the end of the sock or stocking in an automated and fast manner and with known solutions.

SUMMARY

It can be inferred from the above that known methods and related machines for making the toes of socks and stocking are thus characterized by an operating cycle which can be hardly used for manufacturing textile items with a high quality and/or comfort of use.

Under these circumstances, the aim underlying the present invention in its various aspects and/or embodiments is to provide a method and an apparatus for sewing the toe of tubular textile items which can obviate one or more of the drawbacks referred to above.

A further aim of the present invention is to provide a method and an apparatus for sewing the toe of tubular textile items which allow to manufacture socks and stockings with a high aesthetic and functional quality and characterized by a high comfort of use.

A further aim of the present invention is to provide a method and an apparatus for sewing the toe of tubular textile items which allow to automate the production of socks and stockings requiring special comfort and/or aesthetic properties.

Another aim of the present invention is to provide a method and an apparatus for sewing the toe of tubular textile items which allow to obtain for items requiring special comfort and/or aesthetic properties highly uniform items.

Another aim of the present invention is to provide a method and an apparatus for sewing the toe of tubular textile items which allow to make items requiring special comfort and/or aesthetic properties in a simple, fast and/or automated manner.

Another aim of the present invention is to provide an apparatus for sewing the toe of tubular textile items characterized by a simple and rational structure.

A further aim of the present invention is to provide an apparatus for sewing the toe of tubular textile items characterized by low manufacturing costs as far as offered performance and quality are concerned.

A further aim of the present invention is to provide an apparatus for sewing the toe of tubular textile items to be used with existing toe closers and/or to be integrated into existing plants for manufacturing textile items.

These and other possible aims, which shall appear better from the following description, are basically achieved by a method and an apparatus for sewing the toe of tubular textile items according to one or more of the appended claims, each one being considered alone (without those depending on it) or in any combination with the other claims, and according to the following aspects and/or embodiments, variously combined, also with the aforesaid claims.

In a first aspect, the present invention relates to a method for sewing an open end of a tubular textile item, extending along a direction of longitudinal development and ending with said open end, so as to make the toe of a sock or of a leg of a stocking.

In one aspect, the method comprises the step of arranging at least one preparation mold for sewing, designed to receive a tubular item having an open end. In one aspect, the method comprises the step of loading at least partially a tubular item onto said at least one preparation mold, by winding it outside the preparation mold starting from the open end, so that the tubular item is at least partially extended longitudinally on the preparation mold.

In one aspect, the method comprises the step of flattening the tubular item on said at least one preparation mold, so as to define at least at the open end a first side and a second side overlapping and facing each other, each of said first side and second side being provided with a respective end portion at the open end, the end portions being designed to be sewn so as to make a toe of the tubular item. In one aspect, the method comprises the step of pulling the end portion of the first side along the direction of longitudinal development of the tubular item, so that at the open end the end portion of the first side is elongated and longitudinally advanced, with respect to the end portion of the second side, of a length defining a given level of unbalancing.

In one aspect, the method comprises, after the pulling step and by keeping the end portion of the first side pulled, a step of simultaneously blocking the first side and the second side so as to make them as one piece and fix the mutual position thereof, said blocking occurring on respective portions of the first and of the second side that are withdrawn, along the direction of longitudinal development, with respect to said end portions of the two sides, so as to leave the open end designed to be sewn accessible.

In one aspect, the method comprises the step of releasing, by keeping the first side and the second side blocked, the end portion of the first side previously pulled, and taking the preparation mold out of the tubular item.

In one aspect the method comprises the step of simultaneously placing, by keeping the first side and the second side blocked, the respective end portions of the two sides to sewing devices and sewing them, so as to sew the end of the tubular item and make a closed toe of the tubular item. In one aspect, the method comprises the step of releasing the blocking of the first and of the second side.

In one aspect, in said step of pulling the end portion of the first side, such end portion is pulled or tensioned or stretched in an elastic and reversible manner, i.e. by exploiting the elasticity of the tubular textile item.

In one aspect, the step of pulling the end portion of the first side of said given level of unbalancing and the following step of blocking the first side and the second side, by keeping the first side pulled, cause—in the following sewing step the sewing of two portions of the first side and of the second side not corresponding longitudinally to one another, so that after the sewing and the release of the blocking of the first and of the second side, the first side is elastically withdrawn as a result of the elasticity of the tubular textile item, and the sewing results in a position that is longitudinally withdrawn with respect to the toe of the sewn tubular item and wholly on said first side.

In one aspect, said level of unbalancing determines the entity by which the seam on said first side is withdrawn with respect to the toe of the sewn tubular item, i.e. the greater said level of unbalancing, the more the seam is withdrawn.

In one aspect, the toe made by sewing does not include at its end portions of seam, the latter being fully placed on said first side.

In one aspect, said step of flattening the tubular item defines two lateral edges placed between and connecting the first side and the second side and developing along said direction of longitudinal development of the tubular item.

In one aspect, the method comprises, after the step of loading the tubular item onto the preparation mold and before the step of pulling the end portion of the first side, a step of laterally blocking the tubular item at one or both of said lateral edges of the tubular item, so that in the step of pulling the end portion of the first side, the pulling affects the fabric of the first side between the point in which the pulling is applied and the point or points at which the lateral blocking of the tubular item occurs.

In one aspect, said loading step comprises a step of transferring at least partially the tubular item from a loading mold around which the tubular item is wound, to said preparation mold, wherein the loading mold comprises an upper half-mold and a lower half-mold, having a basically semicircular shape and superiorly facing and spaced away from each other, so as to define a free intermediate space, said loading mold being longitudinally movable at least between a withdrawn and an advanced position.

In one aspect, said step of pulling the end portion of the first side occurs by clamping the end portion of the first side and by dragging it along said direction of longitudinal development, so as to elongate the first side of said given level of unbalancing.

In one aspect, the step of pulling the end portion of the first side occurs by means of pulling devices comprising pliers configured for clamping the end portion of the first side, and a linear actuator configured for dragging (the pliers together with) the end portion of the first side along the direction of longitudinal development so as to elongate the first side of said given level of unbalancing.

In one aspect, the step of blocking the first side and the second side occurs by means of blocking devices configured for making the first and second side as one piece to fix the mutual position thereof, said blocking devices comprising at least a blocking element and a blocking plane, wherein the blocking element is configured for simultaneously pressing the first and the second side of the tubular item onto the blocking plane, so as to block them on the blocking plane itself.

In one aspect, in the aforesaid transferring step a longitudinal portion of the tubular item is transferred onto the preparation mold, whereas the remaining longitudinal portion remains wound around the loading mold, preferably until said step of releasing the blocking of the first and of the second side.

In one aspect, the method comprises, after the step of releasing the blocking of the first and of the second side, a step of unloading from the loading mold the tubular item with the sewn toe.

In an independent aspect thereof, the present invention relates to an apparatus for sewing an open end of a tubular textile item, extending along a direction of longitudinal development and ending with said open end, so as to make the toe of a sock or of a leg of a stocking.

In one aspect, the apparatus comprises a preparation station equipped with at least one preparation mold for sewing configured for receiving a tubular item having an open end.

In one aspect, the apparatus comprises loading devices configured for loading at least partially a tubular item onto said at least one preparation mold, by winding it outside the preparation mold starting from the open end, so that the tubular item is at least partially extended longitudinally on the preparation mold.

In one aspect, the apparatus comprises flattening devices configured for flattening the tubular item on said at least one preparation mold, so as to define at least at the open end a first side and a second side overlapping and facing each other, each of said first side and second side being provided with a respective end portion at the open end, the end portions being designed to be sewn so as to make a toe of the tubular item.

In one aspect, the apparatus comprises pulling devices configured for pulling the end portion of the first side along the direction of longitudinal development of the tubular item, so that at the open end the end portion of the first side is elongated and longitudinally advanced, with respect to the end portion of the second side, of a length defining a given level of unbalancing.

In one aspect, the apparatus comprises blocking devices configured for simultaneously blocking the first side and the second side of the tubular item, so as to make them as one piece and fix the mutual position thereof, said blocking devices being configured for acting upon respective portions of the first and of the second side that are withdrawn, along the direction of longitudinal development, with respect to said end portions of the two sides, so as to leave the open end designed to be sewn accessible.

In one aspect, the apparatus comprises sewing devices configured for submitting simultaneously the respective end portions of the two sides to a sewing operation, so as to sew the end of the tubular item and make a closed toe of the tubular item.

In one aspect, the apparatus comprises a loading station, operatively placed upstream from said preparation station, and comprising at least a loading mold, configured for receiving a tubular item wound around it, the loading mold comprising an upper half-mold and a lower half-mold, having a basically semicircular shape and superiorly facing and spaced away from each other, so as to define a free intermediate space, said loading mold being longitudinally movable at least between a withdrawn and an advanced position.

In one aspect, said preparation mold for sewing comprises a pair of blades having a longitudinal development, said blades being arranged parallel to one another and lying on the same horizontal plane, and being further laterally spaced away so as to define between them a free central space, said blades being movable in lateral direction, i.e. orthogonally to the longitudinal development thereof, at least between a closing configuration, in which they are laterally near each other and said central space has a minimum extension, and an opening configuration, in which they are laterally away from each other and said central space has a maximum extension.

In one aspect, the flattening devices comprise said pair of blades of the preparation mold.

In one aspect, in order to load the tubular item onto the preparation mold, the two blades blades move to the closing configuration so that the tubular item can be placed around them, and in order to flatten the tubular item, the two blades move to the opening configuration so as to extend and flatten the tubular item and define said first side and second side.

In one aspect, the flattening devices comprise one or more actuators acting upon said two blades of the preparation mold and configured for selectively causing the switching of the blades between the opening configuration and the closing configuration.

In one aspect, the loading mold and the preparation mold are configured for cooperating with one another so as to transfer at least a longitudinal portion of the tubular item from the loading mold to the preparation mold.

In one aspect, the half-molds of the loading mold are configured for moving, the tubular item being wound outside them, to said advanced position, so that the blades of the pair of blades of the preparation mold, in closing configuration, are positioned inside the free intermediate space between the half-molds of the loading mold.

In one aspect, the two blades of the preparation mold are configured for moving to said opening configuration so that said central space reaches said maximum extension and the blades stretch laterally the tubular item.

In one aspect, the half-molds of the loading mold are configured for moving, the tubular item being wound outside the blades of the preparation mold, to said withdrawn position, so as to pull the loading mold out of the preparation mold and leave the tubular item at least partially wound outside the latter.

In one aspect, the preparation mold comprises a longitudinal drive operatively acting upon said blades and configured for simultaneously moving said blades along a longitudinal direction between a respective advanced position, in which the preparation mold cooperates with the loading mold so as to receive from the latter a tubular item, and a respective withdrawn position, in which the tubular item that has previously been flattened and blocked is taken out of the preparation mold.

In one aspect, the pulling devices comprise pliers configured for clamping the end portion of the first side, and a linear actuator operatively connected to said pliers and configured for dragging the pliers together with the end portion of the first side along the direction of longitudinal development so as to elongate the first side of said given level of unbalancing.

In one aspect, the pliers comprise an upper arm and a lower arm, hinged in a pivot, and are configured for taking a closing configuration, in which the two arms are close together, preferably parallel to one another, and an opening configuration, in which at least one of the two arms is angularly rotated around said pivot with respect to the other arm, so as that the two arms are spaced apart from each other.

In one aspect, the lower arm is configured for fitting in between the first side and the second side of the tubular item, inside the latter, whereas the upper arm is configured for being placed above the first side and outside the tubular item.

In one aspect, said linear actuator can be moved from an advanced position, in which it allows the lower arm to be fitted in between the first side and the second side of the tubular item, and a withdrawn position, in which it pulls the first side of the tubular item.

In one aspect, when the pliers are in opening configuration and the linear actuator is in advanced position, the lower arm fits in between the first side and the second side of the tubular item wound around the blades of the preparation mold, and the upper arm is placed above the first side and spaced apart from the latter, whereas when the pliers are in closing configuration and the linear actuator is in advanced position, the lower arm fits in between the first side and the second side of the tubular item, and the upper arm is pressed against the first side of the tubular item from above, so that the first side is clamped between the two arms.

In one aspect, the switching between the opening configuration and the closing configuration occurs by a movement, in particular a rotation around said pivot, of the upper arm with respect to the lower arm.

In one aspect, in the switching between the opening configuration and the closing configuration the lower arm is fixed and aligned with the preparation mold so as to be able to fit in between the first side and the second side of the tubular item.

In one aspect, the pliers comprise at least an opening/closing actuator, operatively connected at least to said upper arm and configured for selectively switching the pliers between the opening configuration and the closing configuration.

In one aspect, the pulling devices are placed in the preparation station, preferably they are operatively associated to the preparation mold.

In one aspect, the aforesaid pliers are mounted on the preparation mold and as one piece with the latter. In one aspect, the blocking devices are placed in said preparation station.

In one aspect, the blocking devices comprises at least a blocking element and a blocking plane, wherein the blocking element is configured for simultaneously pressing the first and the second side of the tubular item onto the blocking plane, so as to block them on the blocking plane itself. In one aspect, the blocking element can be a presser or a belt or a plate or a pad. In one aspect, said sewing devices comprise a sewing machine.

In one aspect, the blocking element is configured for moving, by keeping the first and second side blocked together as one piece, with respect to the blocking plane, in order to move the first side and the second side to a sewing machine to execute said step of sewing the open end of the tubular item.

In one aspect, the blocking devices comprise a belt drive configured for moving the pad towards said sewing devices.

In one aspect, the apparatus comprises a sewing station, operatively placed downstream from said preparation station, and comprising said sewing devices comprising a sewing machine.

In one aspect, said sewing devices comprise a cutting-sewing machine configured for making the aforesaid sewing of the tubular item and, simultaneously or afterwards, cutting the portions of the tubular item longitudinally exceeding the executed seam and constituting remaining portions, so as to finish the executed seam.

In one aspect, the loading mold is configured for keeping the portion of tubular item that has not been transferred onto the preparation mold wound around it, until the toe is sewn.

In one aspect, the loading station can comprise a turntable comprising a plurality of loading molds, said turntable being configured for moving one after the other each of the loading molds to a position aligned with said preparation mold, where the tubular item is at least partially transferred from the loading mold to the preparation mold.

In one aspect, the loading devices comprise a respective linear actuator configured for longitudinally moving the loading mold at least between said withdrawn position and said advanced position.

In one aspect, the respective linear actuator of the loading devices is operatively associated to the loading mold.

In one aspect, said respective linear actuator of the loading devices is configured for operating on each loading mold when, during the rotation imparted by said turntable, the loading mold is aligned with the preparation mold.

In one aspect, the turntable is configured for positioning the rotating loading molds in further positions, in which further operations are executed on the tubular item, i.e. positioning the loading molds in said sewing station.

In a further independent aspect thereof, the present invention relates to a textile article comprising a tubular textile item extending along a direction of longitudinal development and ending with a sewn end, so as to make the toe of a sock or of a leg of a stocking, the textile article being made with the sewing method according to the present invention and/or by means of the sewing apparatus according to the present invention. In one aspect, the aforesaid end of the textile article is equipped with a closed toe by means of a seam placed in a position that is longitudinally withdrawn with respect to the end of the toe of the tubular item and wholly lying on a first side of the tubular item.

In a further independent aspect thereof, the present invention relates to a machine for manufacturing socks and/or stockings comprising an apparatus according to any one of the claims and/or of the aspects and/or configured and arranged for implementing the method according to any one of the claims and/or of the aspects.

Each one of the aforesaid aspects of the invention can be considered alone or in combination with any one of the claims or of the other aspects as described.

BRIEF DESCRIPTION OF THE DRAWINGS

Further characteristics and advantages shall be more evident from the detailed description of some embodiments, among which also a preferred embodiment, which are exemplary though not exclusive, of a method and an apparatus for sewing the toe of tubular items according to the present invention. This description shall be made below with reference to the accompanying drawings, provided to a merely indicative and therefore non-limiting purpose, in which.

With reference to the mentioned figures, the numeral 1 globally designates an apparatus for sewing the toe of tubular items according to the present invention. Generally, the same numeral is used for identical or similar elements, if applicable in their variants of embodiment.

DETAILED DESCRIPTION

Figure 1:
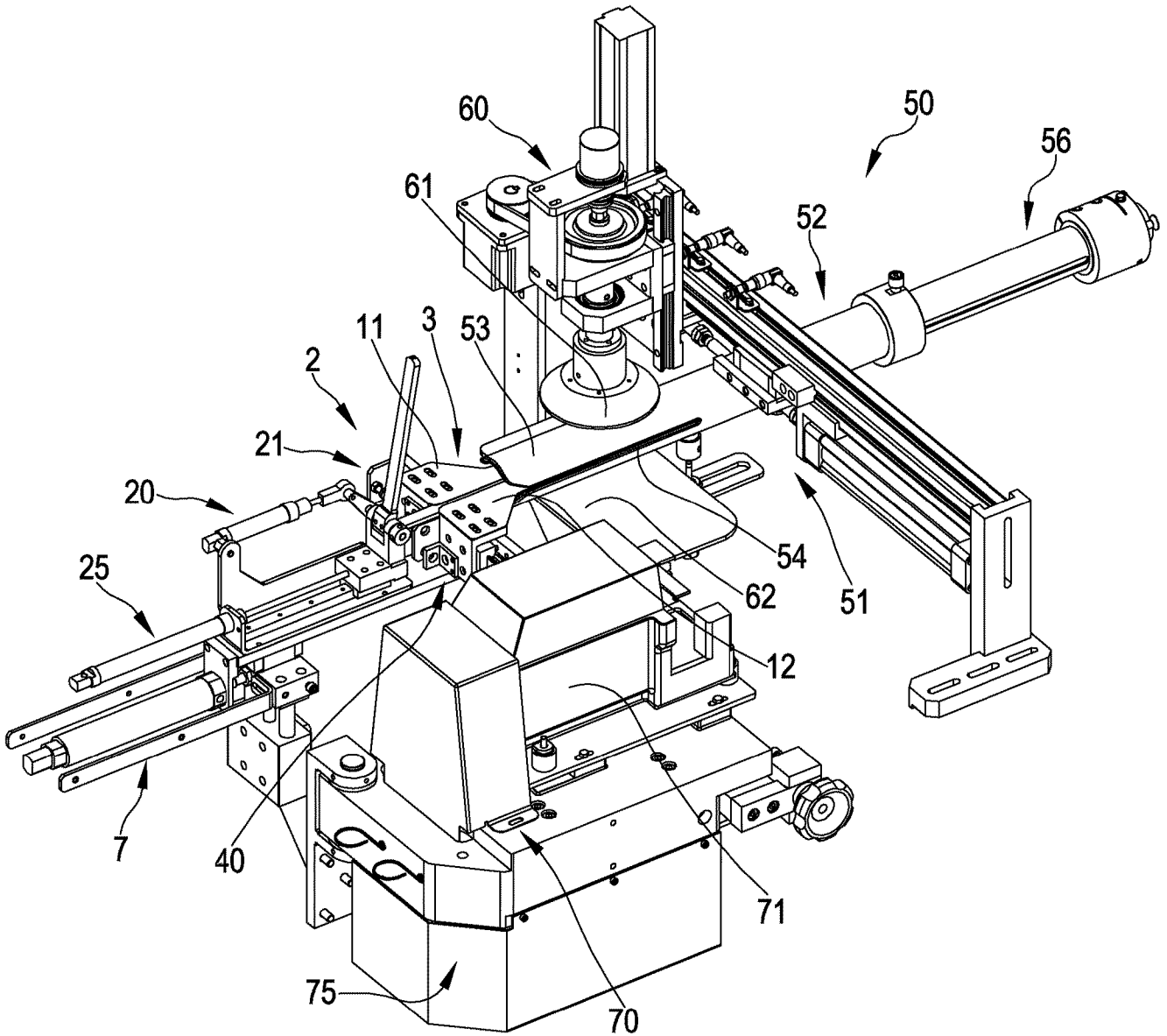
FIG. 1 shows a perspective view of a possible embodiment of an apparatus for sewing the toe of tubular items according to the present invention, in particular for executing a method for sewing the toe of tubular items according to the present invention.
Figure 2:
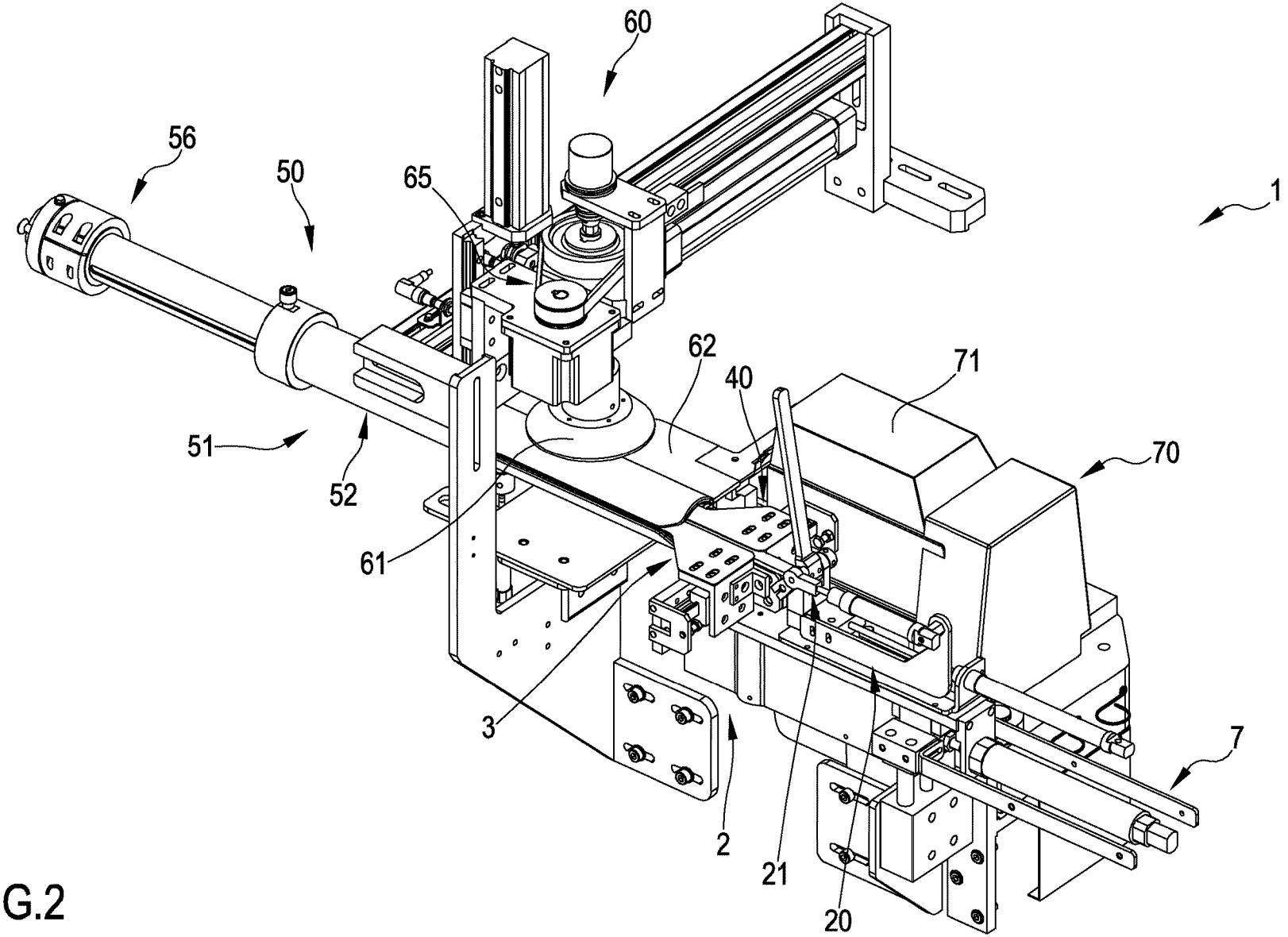
FIG. 2 shows a further perspective view of the apparatus of FIG. 1.
Figure 3:
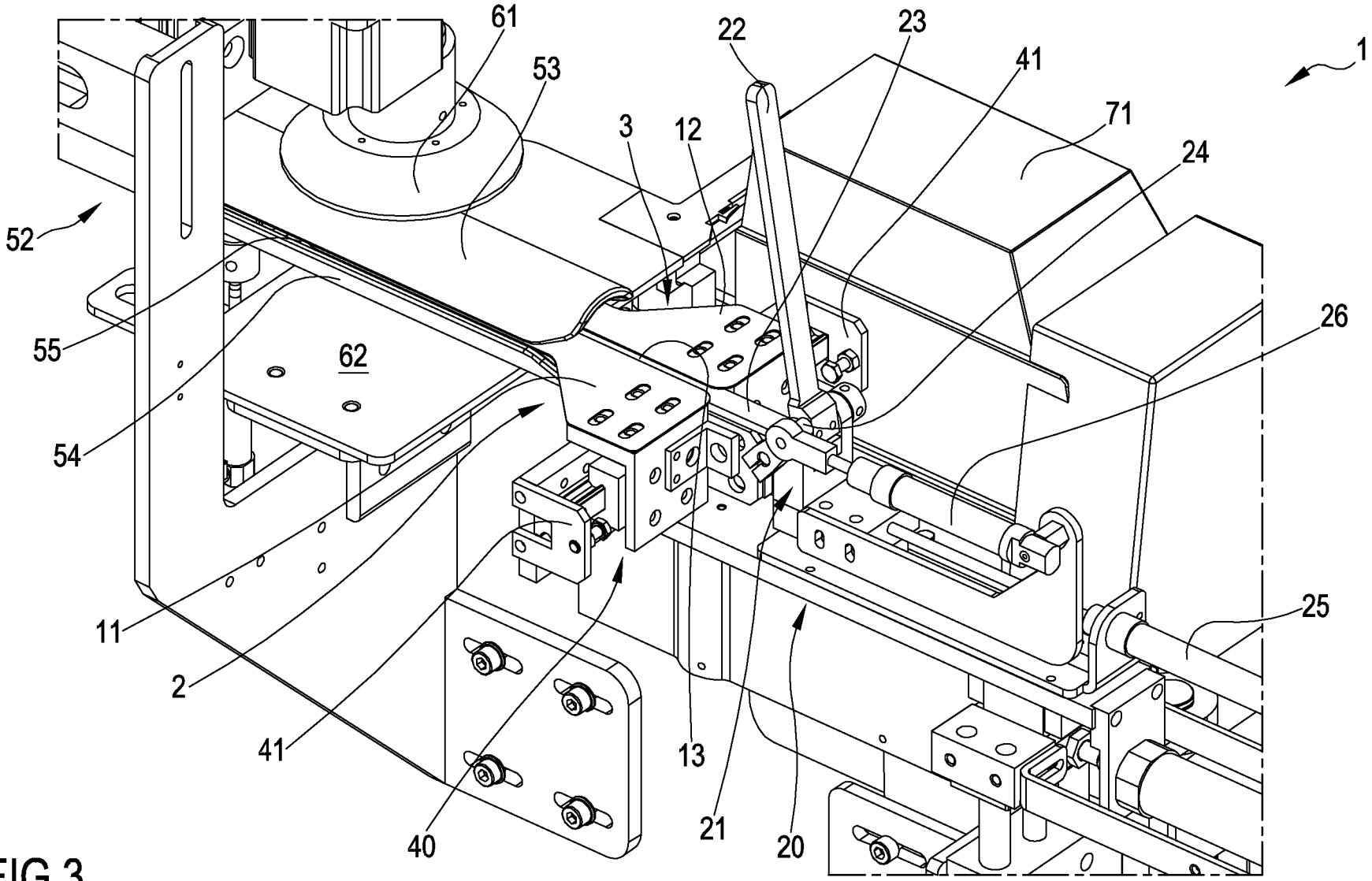
FIG. 3 shows a magnified view of a portion of the apparatus of FIG. 2.
Figure 4:
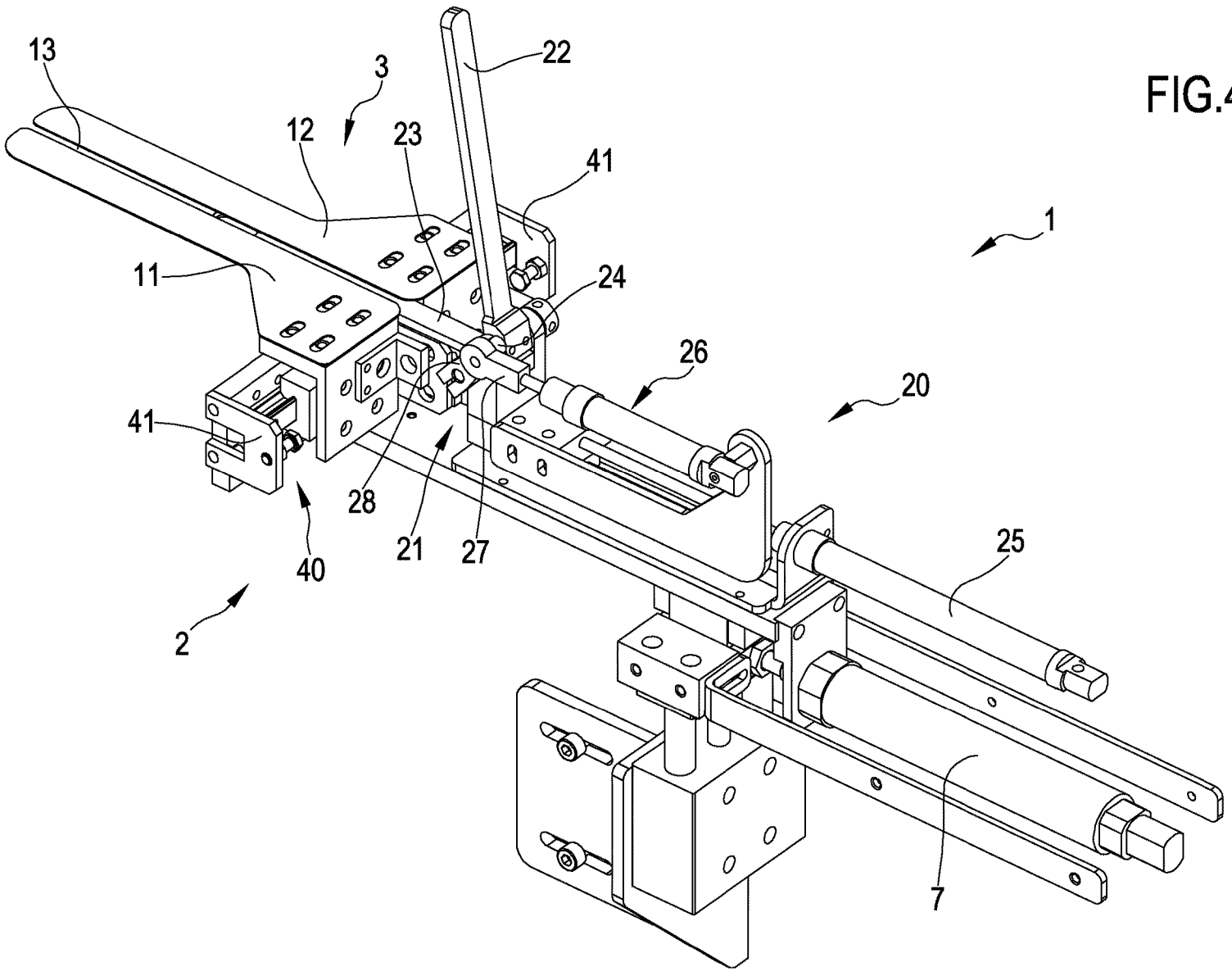
FIG. 4 shows a perspective view of a portion of the apparatus of FIG. 1, in particular of the preparation station.

The apparatus of the present invention is configured for acting upon tubular textile items, in particular for tubular items that are typically used for manufacturing stockings and are designed each to make the leg of a stocking, or upon tubular items designed to make a sock or a hosiery item.

By way of example, each tubular textile item extends along a direction of longitudinal development X and ends with an open end designed to be sewn so as to make the toe of a sock or of a leg of a stocking.

The apparatus 1 comprises:

a preparation station 2, equipped with at least one preparation mold for sewing 3 configured for receiving a tubular item H having an open end 4;

loading devices 50 configured for loading at least partially a tubular item H onto said at least one preparation mold 3, by winding it outside the preparation mold starting from the open end 4, so that the tubular item is at least partially extended longitudinally on the preparation mold;

flattening devices 40 configured for flattening the tubular item H on the preparation mold 3, so as to define at least at the open end 4 a first side 5 and a second side 6 overlapping and facing each other.

Each of said first side 5 and second side 6 is provided with a respective end portion 5*a* and 6*a* at the open end 4; the end portions are designed to be sewn so as to make a toe of the tubular item.

The apparatus 1 further comprises pulling devices 20 configured for pulling the end portion 5*a* of the first side along the direction of longitudinal development X of the tubular item H, so that at the open end 4 the end portion 5*a* of the first side 5 is elongated and longitudinally advanced, with respect to the end portion 6*a* of the second side 6, of a length defining a given level of unbalancing.

The apparatus 1 comprises blocking devices 60 configured for simultaneously blocking the first side 5 and the second side 6 of the tubular item H, so as to make them as one piece and fix the mutual position thereof. The blocking devices 60 are configured for acting upon respective portions of the first and of the second side that are withdrawn, along the direction of longitudinal development X, with respect to the end portions 5*a* and 6*a* of the two sides 5 and 6, so as to leave the open end 4 designed to be sewn accessible.

The apparatus 1 comprises sewing devices 70 configured for submitting simultaneously the respective end portions 5*a* and 6*a* of the two sides 5 and 6 to a sewing operation, so as to sew the open end 4 of the tubular item and make a closed toe of the tubular item.

In a preferred embodiment, the apparatus 1 is configured in particular for executing the following operating cycle (as shall appear better in the following description of the method of the present invention):

by means of the loading devices 50, loading at least partially a tubular item H onto said at least one preparation mold 3, by winding it outside the preparation mold starting from the open end 4, so that the tubular item is H at least partially extended longitudinally on the preparation mold;

by means of the flattening devices 40, flattening the tubular item H on the preparation mold 3, so as to define at least at the open end 4 the first side 5 and the second side 6 overlapping and facing each other, and provided with the respective end portion 5*a* and 6*a* at the open end 4;

by means of the pulling devices 20, pulling the end portion 5*a* of the first side 5 along the direction of longitudinal development X of the tubular item, so that at the open end the end portion of the first side 5*a* is elongated and longitudinally advanced, with respect to the end portion 6*a* of the second side 6, of a length defining a given level of unbalancing;

then, by keeping the end portion 5*a* of the first side 5 pulled, simultaneously blocking by means of the blocking devices 60 the first side 5 and the second side 6 so as to make them as one piece and fix the mutual position thereof;

by keeping the first side 5 and the second side 6 blocked, releasing the end portion 5*a* of the first side previously pulled, and taking the preparation mold 3 out of the tubular item H;

by keeping the first side 5 and the second side 6 blocked, simultaneously submitting the respective end portions 5*a* and 6*a* of the two sides 5 and 6 to the sewing devices 70 and sewing them, so as to sew the end of the tubular item and make the closed toe;

releasing the blocking of the first side 5 and of the second side 6.

As shown by way of example in the figures, the apparatus 1 preferably comprises a loading station 51, operatively placed upstream from the preparation station 2, and provided with at least a loading mold 52, configured for receiving a tubular item wound around it. Preferably, the loading mold 52 comprises an upper half-mold 53 and a lower half-mold 54, having a basically semicircular shape and superiorly facing and spaced away from each other, so as to define a free intermediate space 55. Preferably, the loading mold 52 is longitudinally movable at least between a withdrawn position and an advanced position.

Preferably, the preparation mold 3 comprises a pair of blades 11 and 12 having a longitudinal development designed to coincide with or be parallel to said direction of longitudinal development X of the tubular item H when the latter is at least partially fitted onto the preparation mold.

Preferably, the blades 11 and 12 are arranged parallel to one another and lie on the same horizontal plane; moreover, they are laterally spaced away so as to define between them a free central space 13. Preferably, the blades 11 and 12 are movable in lateral direction, i.e. orthogonally to the longitudinal development thereof, at least between a closing configuration, in which they are laterally near each other and the central space 13 has a minimum extension, and an opening configuration, in which they are laterally away from each other and the central space 13 has a maximum extension.

Preferably, the flattening devices 40 comprise the aforesaid pair of blades 11 and 12 of the preparation mold 3.

Preferably, in order to load the tubular item H onto the preparation mold 3, the two blades 11 and 12 move to the closing configuration so that the tubular item can be placed around them, whereas in order to flatten the tubular item, the two blades 11 and 12 move to the opening configuration so as to extend and flatten the tubular item and define the aforesaid first side 5 and second side 6. In FIGS. 1-5 the blades are shown in closing configuration, whereas in FIGS. 6-7 they are shown in opening configuration, as explained also further below.

Preferably, the flattening devices 40 comprise one or more actuators 41 acting upon the two blades 11 and 12 of the preparation mold 3 and configured for selectively causing the switching of the blades between the opening configuration and the closing configuration. The figures show by way of example two linear actuators 41, each of them acting upon a respective blade; these actuators are synchronized in order to space apart and move close to each other the two blades simultaneously so as to move them to the opening and closing configuration, respectively.

Preferably, the loading mold 52 and the preparation mold 3 are configured for cooperating with one another so as to transfer at least a longitudinal portion of the tubular item from the loading mold to the preparation mold.

Preferably, the half-molds 53 and 54 of the loading form 52 are configured for moving, the tubular item H being wound outside them, to said advanced position, so that the blades 11 and 12 of the pair of blades of the preparation mold 3, in closing configuration, are positioned inside the free intermediate space 55 between the half-molds of the loading mold. Preferably, the two blades 11 and 12 of the preparation mold 3 are configured for moving to said opening configuration so that the central space 13 reaches said maximum extension and the blades stretch laterally the tubular item H.

Preferably, the half-molds 53 and 54 of the loading form 52 are configured for moving, the tubular item H being wound outside the blades 11 and 12 of the preparation form 3, to said withdrawn position, so as to pull the loading mold 52 out of the preparation mold 3 and leave the tubular item at least partially wound outside the latter.

Preferably, the preparation mold 3 comprises a longitudinal drive 7 operatively acting upon said blades 11 and 12 and configured for simultaneously moving them along a longitudinal direction between a respective advanced position, in which the preparation mold 3 cooperates with the loading form 52 so as to receive from the latter a tubular item H, and a respective withdrawn position, in which the tubular item that has previously been flattened and blocked is taken out of the preparation mold.

Preferably, the pulling devices 20 comprise pliers 21 configured for clamping the end portion of the first side 5, and a linear actuator 25 operatively connected to the pliers and configured for dragging the pliers together with the end portion 5*a* of the first side 5 along the direction of longitudinal development X so as to elongate the first side 5 of said given level of unbalancing.

Preferably, the linear actuator 25 is a pneumatic piston or a linear motor or a belt-driven slide.

Preferably, the pliers 21 comprise an upper arm 22 and a lower arm 23, hinged in a pivot 24, and are configured for taking a closing configuration, in which the two arms 22 and 23 are close together, preferably parallel to one another, and an opening configuration, in which at least one of the two arms (in the examples of the figures the upper arm 22) is angularly rotated around the pivot 24 with respect to the other arm (in the example of the figures the lower arm 23), so that the two arms are spaced apart from each other.

Preferably, the lower arm 23 is configured for fitting in between the first side 5 and the second side 6 of the tubular item H, inside the latter, whereas the upper arm 23 is configured for being placed above the first side 5 and outside the tubular item H.

Preferably, the linear actuator 25 of the pulling devices can be moved from an advanced position, in which it allows the lower arm 23 to be fitted in between the first side 5 and the second side 6 of the tubular item, and a withdrawn position, in which it pulls the first side 5 of the tubular item.

Preferably, when the pliers 21 are in opening configuration and the linear actuator 25 is in advanced position, the lower arm 23 fits in between the first side 5 and the second side of the tubular item wound around the blades 11 and 12 of the preparation mold 3, and the upper arm 22 is placed above the first side 5 and spaced apart from the latter, whereas when the pliers 21 are in closing configuration and the linear actuator 25 is in advanced position, the lower arm 23 fits in between the first side 5 and the second side 6 of the tubular item, and the upper arm 22 is pressed against the first side 5 of the tubular item from above, so that the first side 5 is clamped between the two arms 22 and 23.

Preferably, the switching between the opening configuration and the closing configuration occurs by a movement, in particular a rotation around the pivot 24, of the upper arm 22 with respect to the lower arm 23.

Preferably, in the switching between the opening configuration and the closing configuration the lower arm is fixed and aligned with the preparation mold so as to be able to fit in between the first side 5 and the second side 6 of the tubular item; in the aforesaid switching only the upper arm moves.

Preferably, the pliers 21 comprise at least an opening/closing actuator 26, operatively connected at least to the upper arm 22 and configured for selectively switching the pliers between the opening configuration and the closing configuration. Preferably, this opening/closing actuator 26 comprises a respective piston 27 and an actuating lever 28, wherein the actuating lever has a first end connected to the upper arm, preferably on the fulcrum, and a second end connected to an operating end of the piston so that an advancing movement of the operating end of the piston corresponds to a forward rotation of the lever and the closing of the upper arm of the pliers onto the lower arm, and a withdrawing movement of the operating end of the piston corresponds to a backward rotation of the lever and the opening of the upper arm with respect to the lower arm.

Preferably, the pulling devices 20 are placed in the preparation station 2, still more preferably they are operatively associated to the preparation mold 3. Preferably, the pliers 21 are mounted on the preparation mold 3 and as one piece with the latter.

Preferably, the blocking devices are placed in the preparation station 2.

Preferably, the blocking devices 60 comprises at least a blocking element 61 and a blocking plane 62: the blocking element is configured for simultaneously pressing the first side 5 and the second side 6 of the tubular item H onto the blocking plane 62, so as to block them on the blocking plane itself.

The blocking element 61 can be a presser or a belt or a plate or a pad: these blocking elements are known per se in the field of toe closers.

Preferably, the sewing devices 70 comprise a sewing machine 71. Preferably, the blocking element 61 is configured for moving, by keeping the first and second side blocked together as one piece, with respect to the blocking plane 62, in order to move the first 5 and the second side 6 to the sewing machine 71 to execute the step of sewing the open end 4 of the tubular item.

Preferably, the blocking devices 60 comprise a belt drive 65 configured for moving the blocking element (e.g. the pad shown in the figures) towards the sewing devices.

Preferably, the apparatus comprises a sewing station 75, operatively placed downstream from said preparation station 2, and comprising the aforesaid sewing devices 70 comprising a sewing machine.

Preferably, the sewing devices comprise a cutting-sewing machine 71 configured for making the aforesaid sewing of the tubular item and, simultaneously or afterwards, cutting the portions of the tubular item longitudinally exceeding the executed seam and constituting remaining portions, so as to finish the executed seam.

The cutting-sewing machine 71 (schematically shown in the figures) can be an "overlook" "cutting-sewing" machine, e.g. a machine as those produced by UNION SPECIAL® in one of the models of series 9M or the like.

Preferably, the loading mold 52 is configured for keeping the portion of tubular item that has not been transferred onto the preparation mold wound around it, until the toe is sewn.

In one embodiment (not shown), the loading station can comprise a turntable comprising a plurality of loading molds; this turntable is configured for moving one after the other each of the loading molds to a position aligned with the preparation mold, where the tubular item is at least partially transferred from the loading mold to the preparation mold.

Preferably, the loading devices 50 comprise a respective linear actuator 56 configured for longitudinally moving the loading mold at least between the withdrawn position and the advanced position.

Preferably, the respective linear actuator of the loading devices is operatively associated to the loading mold.

As an alternative, the respective linear actuator of the loading devices is configured for operating on each loading mold when, during the rotation imparted by the turntable, the loading mold is aligned with the preparation mold.

Preferably, the turntable is configured for positioning the rotating loading molds in further positions, in which further operations are executed on the tubular item, i.e. positioning the loading molds in said sewing station.

It should be observed that in the figures both the loading mold 52 and the preparation mold 3 are always shown in their respective advanced position; in detail, the loading mold 52 is advanced when it is placed so as to enclose the preparation mold, and the preparation mold is advanced when it fits into the preparation mold. Basically, the two molds are shown by way of example in the figures in their reciprocal configuration in which the tubular textile item is transferred (partially, a portion thereof comprising the open end).

When the loading mold gets back, it leaves a portion wound around the preparation mold, whereas when (later) the latter gets back in its turn, the flattened and blocked portion of the tubular item remains pressed between the blocking element and the blocking plane so as to be sewn.

The apparatus 1 described above is particularly suitable, though not exclusively, for implementing the method for sewing an open end of a tubular textile item of the present invention.

As disclosed above and clearly shown in the figures, the method comprises the following steps:

arranging at least one preparation mold 3 for sewing, designed to receive a tubular item H having an open end 4;

loading at least partially a tubular item H onto the preparation mold 3, by winding it outside it starting from the open end, so that the tubular item is at least partially extended longitudinally on the preparation form;

flattening the tubular item H on the preparation mold 3, so as to define at least at the open end 4 the first side 5 and the second side 6 overlapping and facing each other, wherein the first side 5 and the second side 6 are provided with a respective end portion 5*a* and 6*a* at the open end 4, the end portions being designed to be sewn so as to make a toe of the tubular item;

pulling the end portion 5*a* of the first side 5 along the direction of longitudinal development X of the tubular item, so that at the open end the end portion of the first side is elongated and longitudinally advanced, with respect to the end portion of the second side, of a length defining a given level of unbalancing;

then, by keeping the end portion 5*a* of the first side 5 pulled, simultaneously blocking the first side 5 and the second side 6 so as to make them as one piece and fix the mutual position thereof; the blocking occurs on respective portions of the first and of the second side that are withdrawn, along the direction of longitudinal development, with respect to the end portions 5*a* and 6*a* of the two sides, so as to leave the open end designed to be sewn accessible;

by keeping the first side and the second side blocked, releasing the end portion of the first side previously pulled, and taking the preparation mold 3 out of the tubular item;

by keeping the first side and the second side blocked, simultaneously placing the respective end portions of the two sides to sewing devices and sewing them, so as to sew the end of the tubular item and make a closed toe of the tubular item;

releasing the blocking of the first side and the second side.

Basically, the method of the present invention includes the following sequence of operations on a tubular textile item, so as to make a sewn toe having certain characteristics:

loading the tubular item onto the preparation mold;

flattening the tubular item, at least at the open end;

pulling the first side (only) of the tubular item;

blocking both sides of the tubular item;

taking the preparation form out and sewing the ends of the two sides, thus making a closed toe;

releasing the blocking and unloading the items thus sewn.

Preferably, in the step of pulling the end portion of the first side, such end portion is pulled or tensioned or stretched in an elastic and reversible manner, i.e. by exploiting the elasticity of the tubular textile item.

Preferably, the step of pulling the end portion of the first side of the aforesaid given level of unbalancing and the following step of blocking the first side and the second side, by keeping the first side pulled, cause—in the following sewing step—the sewing of two portions of the first side and of the second side not corresponding longitudinally to one another, so that after the sewing and the release of the blocking of the first and of the second side, the first side is elastically withdrawn as a result of the elasticity of the tubular textile item, and the sewing results in a position that is longitudinally withdrawn with respect to the toe of the sewn tubular item and wholly on said first side.

Preferably, in the step of pulling the first side of the tubular item, the second side is left untouched and is not submitted to any pulling operation.

In the exemplary embodiment shown in the figures, the first side 5 is by way of example the upper side of the tubular item as positioned in the apparatus, whereas the second side corresponds to the lower side. However, it is evident that the apparatus and the method of the present invention can work exactly the same way considering as the first side the lower side of the textile item. Typically, the first side (on which the seam is present at the end of the operations carried out with the present method and apparatus) is the one designed to contact the user's foot plant (i.e. to be the lower side of the sock or stocking in use).

Preferably, the step of sewing the first side and the second side occurs on a sewing line or curve transversally defined with respect to the tubular item and affecting longitudinally corresponding portions of the first side and of the second side kept blocked.

Preferably, the level of unbalancing determines the entity by which the seam on said first side is withdrawn with respect to the toe of the sewn tubular item, i.e. the greater the level of unbalancing, the more the seam is withdrawn.

Preferably, the toe made by sewing does not include at its end portions of seam, the latter being fully placed on the first side.

Preferably, the step of flattening the tubular item defines two lateral edges 15 and 16 placed between and connecting the first side 5 and the second side 6 and developing the said direction of longitudinal development of the tubular item.

Preferably, the method comprises, after the step of loading the tubular item H onto the preparation mold 3 and before the step of pulling the end portion 5*a* of the first side 5, a step of laterally blocking the tubular item at one or both of the aforesaid lateral edges 15 and 16, so that in the step of pulling the end portion of the first side, the pulling affects the fabric of the first side between the point in which the pulling is applied (or gripping point) and the point or points at which the lateral blocking of the tubular item occurs.

Preferably, the loading step comprises a step of transferring at least partially the tubular item from a loading mold 52 around which the tubular item is wound, to said preparation mold 3. Preferably, in the step of loading the tubular item onto the preparation mold, the two blades 11 and 12 are in closing configuration so that the tubular item can be placed around them, and in the step of flattening the tubular item, the two blades 11 and 12 move to the opening configuration so as to extend and flatten the tubular item and define the first side 5 and second side 6.

Preferably, in the loading step the aforesaid step of transferring at least partially the tubular item from a loading mold to a preparation mold comprises the steps of:

- the tubular item being wound outside the loading form, moving the half-molds of the loading form in advanced position, so that the blades of the pair of blades of the preparation mold, in closing configuration, are positioned inside the free intermediate space between the half-molds of the loading mold;
- moving the blades of the pair of blades of the preparation mold to the opening configuration, so that said central space reaches said maximum extension and the blades stretch laterally at least a longitudinal portion of the tubular item;
- the tubular item being wound outside the blades of the preparation mold, moving the half-molds of the loading mold in withdrawn position, so as to pull the loading mold out of the preparation mold and leave at least a longitudinal portion of the tubular item wound outside the latter.

Figure 5:
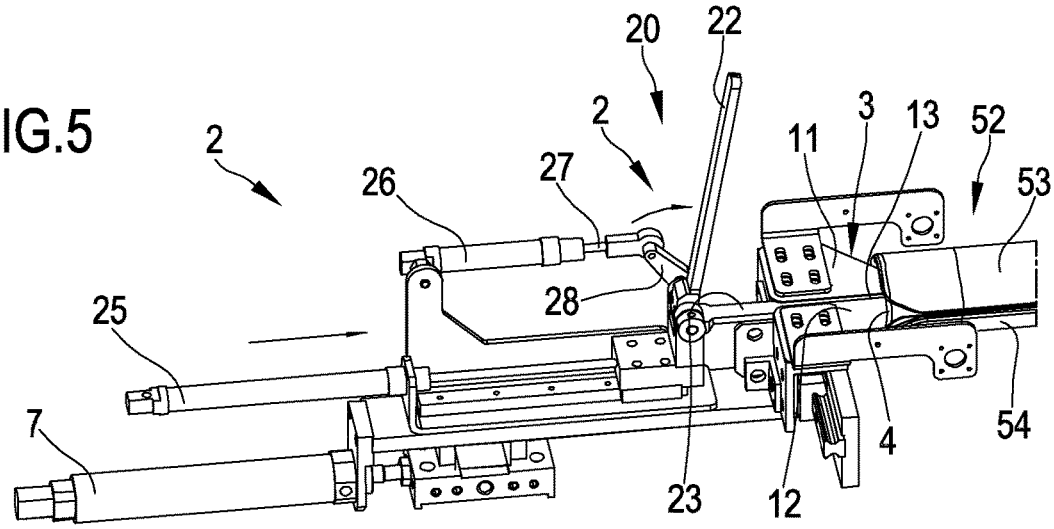
FIGS. 5, 6 and 7 show perspective views of a portion of the apparatus of FIG. 1, each of them illustrating a respective specific step of the method for sewing the toe of tubular items according to the present invention.
Figure 6:
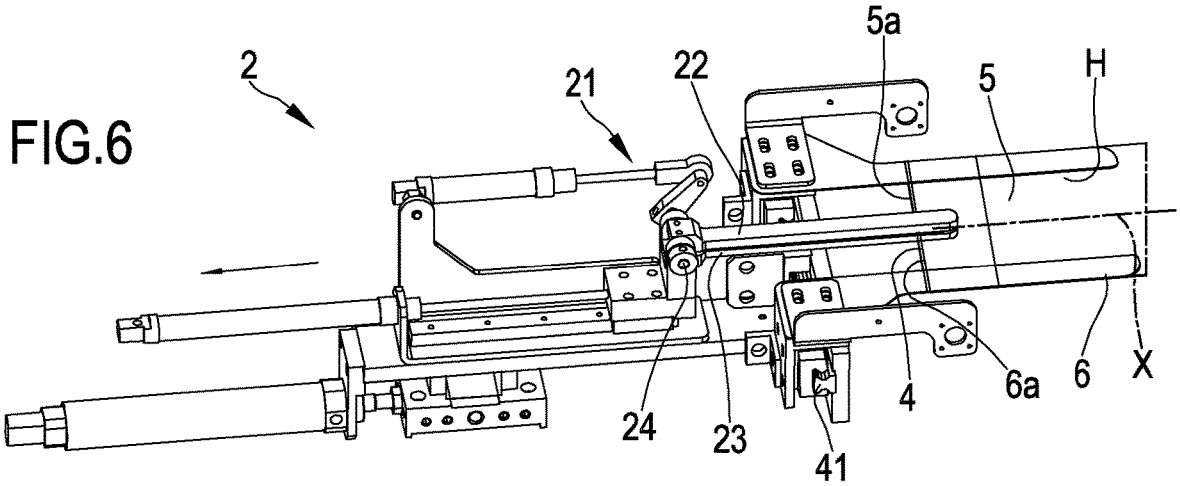
Figure 7:
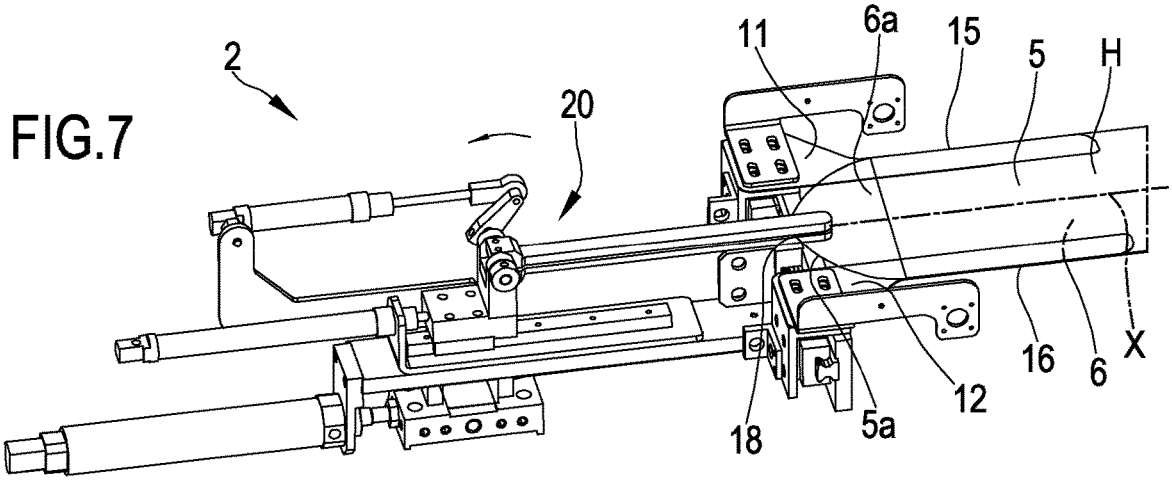

In FIGS. 1-5 the blades 11 and 12 of the preparation mold 3 are shown in closing configuration, whereas in FIGS. 6-7 they are shown in opening configuration.

Globally, the figures (in particular FIGS. 5, 6 and 7) show the different positions and configurations taken by the preparation mold and by the loading mold of the apparatus during an operating cycle.

FIGS. 5-7 show by way of example the loading, flattening and pulling steps, respectively. In detail:

- FIG. 5 shows the loading mold carrying the tubular item wound to the two half-molds 53 and 54; the loading form is in advanced position, so that the preparation mold is fitted inside the intermediate space 55; the two blades 11 and 12 are in closing configuration;
- in FIG. 6 the blades have moved to the opening configuration, thus causing the tubular item to laterally stretch and therefore to flatten (thus defining the first side 5 and the second side 6), the loading mold is therefore withdrawn, thus completing the partial transfer of the tubular item onto the blades of the preparation mold;
- in FIG. 7 the pulling devices (i.e. the pliers 21) pull the end portion 5*a* of the first side 5.

Preferably, the step of laterally blocking the tubular item at one or both lateral edges 15 or 16 takes place on the blades 11 and 12 of the preparation mold after the step of moving the blades of the pair of blades to the opening configuration and before the step of moving the half-molds of the loading mold to the withdrawn position, so as to prevent the tubular item from getting out of the preparation mold while the loading half-molds are withdrawn.

Basically, the lateral blocking of the edges of the tubular item is useful both in the pulling step, where it enables to stretch the end portion of the first side starting from the blocking point as far as the gripping point, and in the step of transferring the tubular item, where it prevents the item from getting out of the blades when the loading mold gets back (precisely to leave the item wound onto the blades).

Preferably, in the step of laterally blocking the tubular item, the blocking occurs at two end portions of the two lateral edges 15 and 16 of the tubular item.

Preferably, the apparatus 1 comprises auxiliary blocking devices (not shown) configured for laterally blocking the tubular item at one or both lateral edges of the tubular item, so that the pulling of the end portion of the first side affects the fabric of the first side between the point in which the pulling is applied and the point or points at which the lateral blocking of the tubular item occurs. Basically, these auxiliary blocking devices are particularly configured for executing the aforesaid step of laterally blocking the tubular item. Preferably, the auxiliary blocking devices are configured for laterally blocking the tubular item, at one or both lateral edges of the tubular item, on the blades of the preparation mold. Preferably, the auxiliary blocking devices are positioned on or associated with said preparation mold. Preferably, the auxiliary blocking devices comprise a pair of lateral pistons, each of them operatively acting upon a respective blade of the preparation mold. Preferably, each lateral piston can be selectively actuated between an active configuration, in which it blocks the lateral edge of the tubular item in a respective point with respect to the respective blade, and a non-active configuration, in which it does not interfere with the respective blade and/or with the tubular item.

Preferably, the step of pulling the end portion of the first side occurs by clamping the end portion of the first side and by dragging it along the direction of longitudinal development, so as to elongate the first side of the aforesaid given level of unbalancing.

Preferably, the pulling of the first side of the tubular item takes place starting from the gripping point 18 (or point in which the pulling is applies), preferably lying a basically central position of the end portion of the first side, with respect to a lateral extension of the first side. The lateral extension is to a cross direction, preferably orthogonally, to the direction of longitudinal development of the tubular item.

Preferably, the pulling of the first side of the tubular item is at its maximum at the gripping point 18 and progressively reduces along said lateral extension of the first side, from two sides with respect to the gripping point (as schematically shown in FIG. 7). Preferably, the pulling of the first side of the tubular item from the gripping point results in an arc shape of the pulled end portion of the first side, the maximum elongation being at the gripping point.

Preferably, the step of pulling the end portion of the first side occurs by means of the aforesaid pulling devices 20. Preferably, the step of blocking the first side and the second side occurs by means of the aforesaid blocking devices 60.

Preferably, the step of taking the preparation mold out of the tubular item occurs by withdrawing the preparation mold along a direction coinciding with the direction of longitudinal development X, so as to leave the tubular item blocked by the blocking element on the blocking plane.

Preferably, the method comprises, after the sewing step, a further step of cutting the portions of the tubular item longitudinally exceeding the executed seam and constituting remaining portions, so as to finish the executed seam. The sewing and the cutting steps can be advantageously executed as one step by cutting and sewing devices comprising a cutting-sewing machine.

Preferably, in the aforesaid transferring step a longitudinal portion of the tubular item is transferred onto the preparation mold, whereas the remaining longitudinal portion remains wound around the loading mold, preferably until the step of releasing the blocking of the first and of the second side. Preferably, the method comprises, after the step of releasing the blocking of the first and of the second side, a step of unloading from the loading mold the tubular item with the sewn toe.

The apparatus described above is particularly suitable, though not exclusively, for implementing the method for sewing an open end of a tubular textile item of the present invention.

Various aspects of the method, corresponding to the further aspects described above and/or implemented by means of components described above and belonging to the apparatus, are not repeated here. The further aspects of the manufacturing process for a stocking or a hosiery item, e.g. concerning the toe closer, that are not described in detail in the present description and not deriving from peculiar characteristics of the apparatus as described above, are to be considered as conventional.

The invention thus conceived can be subjected to various changes and variants, all of which fall within the scope of the inventive idea, and the components mentioned here can be replaced by other technically equivalent element. The invention achieves important advantages. First of all, the invention allows to overcome at least some of the drawbacks of known technique. The invention further allows to make socks and stockings with a high aesthetic and functional quality and characterized by a high comfort of use. The invention enables in particular an automated production of socks and stocking requiring special characteristics as far as comfort and/or appearance are concerned. As a matter of fact, the sequence of steps of the method of the present invention, in which one side of the flattened tubular item is pulled before blocking the two sides for sewing them, allows to sew in an "unbalanced" manner the open end of the tubular item: since one side is previously stretched (elongated), when the blocking means are released (after sewing) there is an "automatic" withdrawal (thanks to the elasticity of the tubular textile item) of the first side, and then a withdrawal of the seam just made, which is therefore no longer positioned exactly at the sock or stocking toe (i.e. at the longitudinal end thereof), but it is withdrawn on the first side. It is thus possible to solve the problems related to uncomfortable feelings and/or unaesthetic appearance of socks and stocking manufactured by means of known apparatuses and methods.

The invention further allows to obtain for items requiring special comfort and/or aesthetic properties highly uniform items.

The invention further allows to make items requiring special comfort and/or aesthetic properties in a simple, fast and/or automated manner.

The apparatus of the present invention is further characterized by a simple and rational structure.

The apparatus of the present invention is further characterized by low manufacturing costs as far as offered performance and quality are concerned.

The invention claimed is:

1. A method for sewing an open end of a tubular textile item, extending along a direction of longitudinal development and ending with said open end, so as to make the toe of a sock or of a leg of a stocking, the method comprising the steps of:

-arranging at least one preparation mold for sewing, designed to receive a tubular item having an open end;

-loading at least partially a tubular item onto said at least one preparation mold, by winding it outside the preparation mold starting from the open end, so that the tubular item is at least partially extended longitudinally on the preparation mold;

-flattening the tubular item on said at least one preparation mold, so as to define at least at the open end a first side and a second side overlapping and facing each other, each of said first side and second side being provided with a respective end portion at the open end, the end portions being designed to be sewn so as to make a toe of the tubular item;

-pulling the end portion of only the first side along the direction of longitudinal development of the tubular item, so that at the open end the end portion of the first side is elongated and longitudinally advanced, with respect to the end portion of the second side, of a length defining a given level of unbalancing;

-then, by keeping the end portion of the first side pulled, simultaneously blocking the first side and the second side so as to make them as one piece and fix the mutual position thereof, said blocking occurring on respective portions of the first and of the second side that are withdrawn, along the direction of longitudinal development, with respect to said end portions of the two sides, so as to leave the open end designed to be sewn accessible;

-by keeping the first side and the second side blocked, releasing the end portion of the first side previously pulled, and taking the preparation mold out of the tubular item;

-by keeping the first side and the second side blocked, simultaneously submitting the respective end portions of the two sides to sewing devices and sewing them, so as to sew the end of the tubular item and make a closed toe of the tubular item;

-releasing the blocking of the first side and of the second side.

2. The method according to claim 1, wherein in said step of pulling the end portion of the first side, such end portion is pulled or tensioned or stretched in an elastic and reversible manner.

3. The method according to claim 1, wherein said level of unbalancing determines the entity by which a seam on said first side is withdrawn with respect to the toe of the sewn tubular item.

4. The method according to claim 1, wherein said step of flattening the tubular item defines two lateral edges placed between and connecting the first side and the second side and developing along said direction of longitudinal development of the tubular item.

5. The method according to claim 1, wherein said loading step comprises a step of transferring at least partially the tubular item from a loading mold around which the tubular item is wound, to said preparation mold, wherein the loading mold comprises an upper half-mold and a lower half-mold, having a semicircular shape and superiorly facing and spaced away from each other, so as to define a free intermediate space, said loading mold being longitudinally movable at least between a withdrawn and an advanced position, and wherein the preparation mold comprises a pair of blades having a longitudinal development, said blades being arranged parallel to one another and lying on the same horizontal plane, and being further laterally spaced away so as to define between them a free central space, said blades being movable in lateral direction, at least between a closing configuration, in which they are laterally near each other and said central space has a minimum extension, and an opening configuration, in which they are laterally away from each other and said central space has a maximum extension, wherein in said step of loading the tubular item onto the preparation mold both blades are in the closing configuration so that the tubular item can be placed around them, and in said step of flattening the tubular item, both blades move to the opening configuration so as to extend and flatten the tubular item and define said first side and second side.

6. The method according to claim 5, wherein in said loading step the aforesaid step of transferring at least partially the tubular item from a loading mold to a preparation mold comprises the steps of:

-the tubular item being wound outside the loading mold, moving the half-molds of the loading mold in advanced position, so that the blades of the pair of blades of the preparation mold, in closing configuration, are positioned inside the free intermediate space between the half-molds of the loading mold;

-moving the blades of the pair of blades of the preparation mold to the opening configuration, so that said central space reaches said maximum extension and the blades stretch laterally at least a longitudinal portion of the tubular item;

-the tubular item being wound outside the blades of the preparation mold, moving the half-molds of the loading mold in withdrawn position, so as to pull the loading mold out of the preparation mold and leave at least a longitudinal portion of the tubular item wound outside the preparation mold.

7. The method according to claim 1, wherein said step of pulling the end portion of the first side occurs by clamping the end portion of the first side and by dragging it along said direction of longitudinal development, so as to elongate the first side of said given level of unbalancing, and/or wherein said step of pulling the end portion of the first side occurs by means of pulling devices comprising pliers configured for clamping the end portion of the first side, and a linear actuator configured for dragging the end portion of the first side along the direction of longitudinal development so as to elongate the first side of said given level of unbalancing.

8. The method according to claim 1, wherein the step of pulling the end portion of the first side of said given level of unbalancing and the following step of blocking the first side and the second side, by keeping the first side pulled, cause the sewing of two portions of the first side and of the second side not corresponding longitudinally to one another, so that after the sewing and the release of the blocking of the first and of the second side, the first side is elastically withdrawn as a result of the elasticity of the tubular textile item, and the sewing results in a position that is longitudinally withdrawn with respect to the toe of the sewn tubular item and wholly on said first side.

9. The method according to claim 1, wherein the step of sewing the first side and the second side occurs on a sewing line or curve transversally defined with respect to the tubular item and affecting longitudinally corresponding portions of the first side and of the second side kept blocked.

10. The method according to claim 1, wherein the toe made by sewing does not include at its end portions of seam, the seam being fully placed on said first side.

11. The method according to claim 1, wherein the method comprises, after the step of loading the tubular item onto the preparation mold and before the step of pulling the end portion of the first side, a step of laterally blocking the tubular item at one or both of said lateral edges of the tubular item, so that in the step of pulling the end portion of the first side, the pulling affects a fabric of the first side between a point in which the pulling is applied and a point or points at which the lateral blocking of the tubular item occurs.

12. The method according to claim 1, wherein said step of pulling the end portion of the first side occurs by means of pulling devices comprising pliers configured for clamping the end portion of the first side, and a linear actuator configured for dragging the end portion of the first side along the direction of longitudinal development so as to elongate the first side of said given level of unbalancing.

13. The method according to claim 1, wherein the step of blocking the first side and the second side occurs by means of blocking devices configured for making the first and second side as one piece to fix the mutual position thereof, said blocking devices comprising at least a blocking element and a blocking plane, wherein the blocking element is configured for simultaneously pressing the first and the second side of the tubular item onto the blocking plane, so as to block them on the blocking plane itself.

14. The method according to claim 13, wherein the blocking element is configured for moving, by keeping the first and second side blocked together as one piece, with respect to the blocking plane, in order to move the first side and the second side to a sewing machine to execute said step of sewing the open end of the tubular item.

15. An apparatus for sewing an open end of a tubular textile item, extending along a direction of longitudinal development and ending with said open end, so as to make the toe of a sock or of a leg of a stocking, the apparatus comprising:

-a preparation station equipped with at least one preparation mold for sewing configured for receiving a tubular item having an open end;

-loading devices configured for loading at least partially a tubular item onto said at least one preparation mold, by winding it outside the preparation mold starting from the open end, so that the tubular item is at least partially extended longitudinally on the preparation mold;

-flattening devices configured for flattening the tubular item on said at least one preparation mold, so as to define at least at the open end a first side and a second side overlapping and facing each other, each of said first side and second side being provided with a respective end portion at the open end, the end portions being designed to be sewn so as to make a toe of the tubular item;

-pulling devices configured for pulling the end portion of only the first side along the direction of longitudinal development of the tubular item, so that at the open end the end portion of the first side is elongated and longitudinally advanced, with respect to the end portion of the second side, of a length defining a given level of unbalancing;

-blocking devices configured for simultaneously blocking the first side and the second side of the tubular item so as to make them as one piece and fix the mutual position thereof, said blocking devices being configured for acting upon respective portions of the first and of the second side that are withdrawn, along the direction of longitudinal development, with respect to said end portions of the two sides, so as to leave the open end designed to be sewn accessible;

-sewing devices configured for submitting simultaneously the respective end portions of the two sides to a sewing operation, so as to sew the open end of the tubular item and make a closed toe of the tubular item.

16. The apparatus according to claim 15, configured for executing the following working cycle:

-by means of said loading devices, loading at least partially a tubular item onto said at least one preparation mold, by winding it outside the preparation mold starting from the open end, so that the tubular item is at least partially extended longitudinally on the preparation mold;

-by means of said flattening devices, flattening the tubular item on said at least one preparation mold, so as to define at least at the open end a first side and a second side overlapping and facing each other, each of said first side and second side being provided with a respective end portion at the open end, the end portions being designed to be sewn so as to make a toe of the tubular item;

-by means of said pulling devices, pulling the end portion of the first side along the direction of longitudinal development of the tubular item, so that at the open end the end portion of the first side is elongated and longitudinally advanced, with respect to the end portion of the second side, of a length defining a given level of unbalancing;

-then, by keeping the end portion of the first side pulled, simultaneously blocking by means of said blocking devices the first side and the second side so as to make them as one piece and fix the mutual position thereof, said blocking occurring on respective portions of the first and of the second side that are withdrawn, along the direction of longitudinal development, with respect to said end portions of the two sides, so as to leave the open end designed to be sewn accessible;

-by keeping the first side and the second side blocked, releasing the end portion of the first side previously pulled, and taking the preparation mold out of the tubular item;

-by keeping the first side and the second side blocked, simultaneously placing the respective end portions of the two sides to said sewing devices and sewing them, so as to sew the end of the tubular item and make a closed toe of the tubular item;

-releasing the blocking of the first side and the second side.

* * * * *